US006984938B2

(12) United States Patent
Kakisaka et al.

(10) Patent No.: US 6,984,938 B2
(45) Date of Patent: Jan. 10, 2006

(54) METAL VAPOR DISCHARGE LAMP AND LIGHTING APPARATUS CAPABLE OF STABLE MAINTENANCE OF CHARACTERISTICS

(75) Inventors: Shunsuke Kakisaka, Ibaraki (JP); Tatsuo Nishimoto, Mino (JP); Masanori Higashi, Takatsuki (JP); Mikio Miura, Takatsuki (JP); Hiroshi Enami, Nishinomiya (JP); Yoshiharu Nishiura, Outsu (JP)

(73) Assignee: Matsushita Electric Industrial Co., LTD, Osaka-fu (JP)

( * ) Notice: Subject to any disclaimer, the term of this patent is extended or adjusted under 35 U.S.C. 154(b) by 201 days.

(21) Appl. No.: 10/641,147

(22) Filed: Aug. 14, 2003

(65) Prior Publication Data

US 2004/0104677 A1 Jun. 3, 2004

(30) Foreign Application Priority Data

Aug. 30, 2002 (JP) ..... 2002-255951
Aug. 30, 2002 (JP) ..... 2002-255952

(51) Int. Cl.
*H01J 17/04* (2006.01)

(52) U.S. Cl. ..... 313/631; 313/574; 313/623

(58) Field of Classification Search ..... 313/570–574, 313/579, 623, 631–633, 331, 491, 626, 638
See application file for complete search history.

(56) References Cited

U.S. PATENT DOCUMENTS 5,424,609 A * 6/1995 Geven et al. ..... 313/623
5,484,315 A * 1/1996 Juengst et al. ..... 445/26
6,208,070 B1 * 3/2001 Sugimoto et al. ..... 313/493
6,215,254 B1 * 4/2001 Honda et al. ..... 315/246

* cited by examiner

*Primary Examiner*—Karabi Guharay
*Assistant Examiner*—German Colón

(57) ABSTRACT

A metal vapor discharge lamp including an arc tube 1 that includes a container 10 and power transmission members 20*a* and 20*b*. The container 10, made of translucent ceramic, is divided into a main tube portion 11 and narrow tube portions 12*a* and 12*b* extending out from both ends of the main tube portion 11. The power transmission members 20*a* and 20*b* respectively include electrode pins 21*a* and 21*b* made of tungsten. Coils 22*a* and 22*b* made of tungsten are respectively wound around ends of electrode pins 21*a* and 21*b*, which are respectively joined with electrode supporting members 23*a* and 23*b* made of conductive cermet. Electrode length L1 is set to (0.041P+0.5) mm to (0.041P+8.0) mm, "P" representing a lamp power in watts. Alternatively, a narrow tube portion length L2 is set to (0.032P+3.5) mm to (0.032P+8.0) mm inclusive.

22 Claims, 6 Drawing Sheets

METAL VAPOR DISCHARGE LAMP AND LIGHTING APPARATUS CAPABLE OF STABLE MAINTENANCE OF CHARACTERISTICS

BACKGROUND OF THE INVENTION (1) Field of the Invention

The present invention relates to a metal vapor discharge lamp, specifically to a metal vapor discharge lamp, and a lighting apparatus having the metal vapor discharge lamp.

(2) Description of the Related Art

The arc tube contained in the metal halide lamp includes a transparent container in which a halogenated metal is sealed as a light emission metal. The transparent container contains a pair of electrodes that are deposited to face each other. The metal halide lamp emits light at a high temperature when the electrodes receives power supply from outside and discharge electricity.

Conventionally, many arc tubes have been made of quarts glass. In recent years, however, arc tubes made of alumina ceramic are often used since alumina ceramic is superior to quarts glass in heat resistance.

To seal the electrodes in an arc tube made of quarts glass, heat and pressure are applied to both ends of the arc tube so that the ends are crushed. In the case of the arc tubes made of alumina ceramic, a container, which is divided into a main tube portion and narrow tube portions extending out from both ends, is first prepared. Two power transmission members are then respectively inserted into the container through the narrow tube portions. A sealing material such as a frit glass in a molten form is then poured into spaces between the inner surfaces of the narrow tube portions and the power transmission members at both ends, so that the arc tube is sealed by the sealing material (Japanese Laid-Open Patent Application No. S57-78763).

Meanwhile, alumina ceramic arc tubes have various advantages, and thus are expected to achieve high-performance lamps.

For example, since alumina ceramic arc tubes can emit light at a higher temperature than quarts glass arc tubes, it is possible to increase the vapor pressure of a material that is to be enclosed in the arc tubes. This is advantageous to achievement of both color rendering and high efficiency.

Also, alumina ceramic has higher reactivity with the halogenated metal enclosed in the arc tube than does quarts glass. This is advantageous to extension of life of the metal halide lamp.

However, metal halide lamps using such an alumina ceramic arc tube have a problem that the color temperature changes during the lamp life. That is to say, even though the metal halide lamps have enough color temperature characteristics to maintain predetermined color temperatures for the lamps at the beginning, the more the lamps are lighted, for example, for 100 hours, 1,000 hours and so on, the lower the color temperature characteristics are.

The reason for this is considered as follows.

In alumina ceramic arc tubes, which are sealed in a manner described above, each main tube portion side of the space between each narrow tube portion and each power transmission member is not filled with the sealing material.

The light emission metal in liquid form gradually slips into the spaces while the lamps are lighted. Especially, when such a lamp is lighted with electrodes being held vertically, the light emission metal enclosed in the arc tube sinks into the space that is lower than the main tube portion of the container.

As the metal sinks into the space, the amount of the metal that contributes to the lighting in the discharge space is reduced. This prevents enough vapor pressure of the metal from being provided, resulting in a change of color temperature.

One might think that this problem could be solved by enclosing enough amount of the light emission metal to prevent the color temperature change. However, when the light emission metal is enclosed too much, the reaction among the metal, electrodes, alumina, and sealing material is promoted. This decreases the lamp life.

Alternatively, the sealing material may be poured into the spaces deeper to reduce the amount of the light emission metal sinking into the spaces. In this case, however, ends of the inserted sealing material come close to the discharge space where the temperature rises to a considerable extent. This promotes the reaction between the sealing material and the light emission metal, resulting in decreased lamp life. Furthermore, cracks are apt to occur to the sealing material inserted in the spaces.

SUMMARY OF THE INVENTION

The first object of the present invention is therefore to provide a metal vapor discharge lamp that prevents the light emission metal from slipping into the spaces and shows less change especially in the color temperature and in other characteristics even after a long-time, continuous lighting of the lamp, and to provide a lighting apparatus that includes the metal vapor discharge lamp.

The second object of the present invention is to solve another problem of metal halide lamps in which an alumina ceramic arc tube is used, the problem is that if the light emission metal contains cerium, the lamp may go out immediately after it is turned on, the phenomenon occurring especially at the initial aging lighting process that is performed immediately after the lamp is manufactured.

The above objects are fulfilled by a metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion, and a length of each electrode (electrode length L1) is in a range of (0.041P+0.5) mm to (0.041P+8.0) mm inclusive, wherein "P" represents a lamp power in watts.

In the above formula, the electrode length L1 is defined as a distance between a tip of the electrode and the end of the electrode connected to the electrode supporting member. Also, the lamp power P indicates a lamp power when the lamp is stably lighted.

With the above-stated construction in which the electrode length L1 is set to no larger than (0.041P+8.0) mm, the light emission metal enclosed in the arc tube is prevented from slipping into the spaces between the inner surfaces of the narrow tube portions and the electrodes. This makes it possible to maintain a satisfactory level of the steam pressure in the discharge space, which contributes to the achievement of a metal vapor discharge lamp that shows less change especially in the color temperature and in other characteristics even after a long-time, continuous lighting of the lamp.

Also, the setting of the electrode length L1 to no smaller than (0.041P+0.5) mm suppresses the reaction between the sealing member and the light emission metal, and prevents cracks from occurring in the sealing member.

In the above metal vapor discharge lamp, it is preferable that a length of a portion of each electrode projecting from each narrow tube portion into the discharge space is in a range of 3.0 mm to 6.5 mm inclusive.

Also, it is preferable that each electrode has heat conductivity of no smaller than 130 W/m*K, and each electrode supporting member has heat conductivity of no larger than 100 W/m*K.

Also, it is preferable that each electrode contains tungsten and/or molybdenum, and each electrode supporting member contains cermet.

Also, it is preferable that a length of each narrow tube portion (narrow tube portion length L2) is in a range of (0.032P+3.5) mm to (0.032P+8.0) mm inclusive to ensure the advantageous effect of suppressing the amount of the light emission metal slipping into the spaces.

Also, it is preferable that the sealing material is inserted into each narrow tube portion from an outer end not facing the discharge space, and a length (represented as "12") of the sealing material in each narrow tube portion is in a range of 3.7 mm to 5.5 mm inclusive to enhance the reliability of the sealing member during life and to maintain the characteristics.

It should be noted here that it has been confirmed through 5experiments that metal vapor discharge lamps having 70 W to 400 W of lamp power show satisfactory levels of the above-stated effects when the electrode length L1 is set to the range of (0.041P+0.5) mm to (0.041P+8.0) mm inclusive.

The above objects are also fulfilled by a metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion, and a length of each narrow tube portion (narrow tube portion length L2) is in a range of (0.032P+3.5) mm to (0.032P+8.0) mm inclusive, wherein "P" represents a lamp power in watts.

With the above-stated construction in which the narrow tube portion length L2 is set to no larger than (0.032P+8.0) mm, the light emission metal enclosed in the arc tube is prevented from slipping into the spaces between the inner surfaces of the narrow tube portions and the electrodes. This makes it possible to maintain a satisfactory level of the steam pressure in the discharge space, which contributes to the achievement of a metal vapor discharge lamp that shows less change in the color temperature and the characteristics after being lighted for a long time in continuation.

Also, the setting of the narrow tube portion length L2 to no smaller than (0.032P+3.5) mm suppresses the reaction between the sealing member and the light emission metal, and prevents cracks from occurring in the sealing member.

Also, when the narrow tube portion length L2 is set to the above-mentioned range, occurrence of the lamp turn-on failure is reduced. This effect is observed to be prominent especially when the enclosed light emission metal contains cerium.

It should be noted here that it has been confirmed through experiments that metal vapor discharge lamps having 70 W to 360 W of lamp power show satisfactory levels of the above-stated effects when the narrow tube portion length L2 is set to the range of (0.032P+3.5) mm to (0.032P+8.0) mm inclusive.

The advantageous effects of suppressing the amount of the light emission metal slipping into the spaces and of reducing occurrence of the lamp turn-on failure can be improved when the narrow tube portion length L2 is set to the range of (0.032P+3.5) mm to (0.032P+6.0) mm inclusive.

Also, it is preferable that the sealing material is inserted into each narrow tube portion from an outer end not facing the discharge space, and a length (represented as "12") of the sealing material in each narrow tube portion is in a range of 3.7 mm to 5.5 mm inclusive to enhance the reliability of the sealing member during life and to maintain the characteristics.

In general, the problem of the light emission metal slipping into the spaces is apt to occur in a metal vapor discharge lamp in which the thickness of each narrow tube portion is no smaller than 1.15 times the thickness of the main tube portion, or in which the main tube portion and the narrow tube portions are formed in one piece without any shrinkage fitting, or in which the arc tube is deposited in an outer tube in which nitrogen is sealed. The present invention is therefore especially effective on these types of metal vapor discharge lamps.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes preferred embodiments of the present invention with reference to the attached drawings.

Embodiment 1

Construction of Entire Metal Vapor Discharge Lamp and Arc Tube

Figure 1:
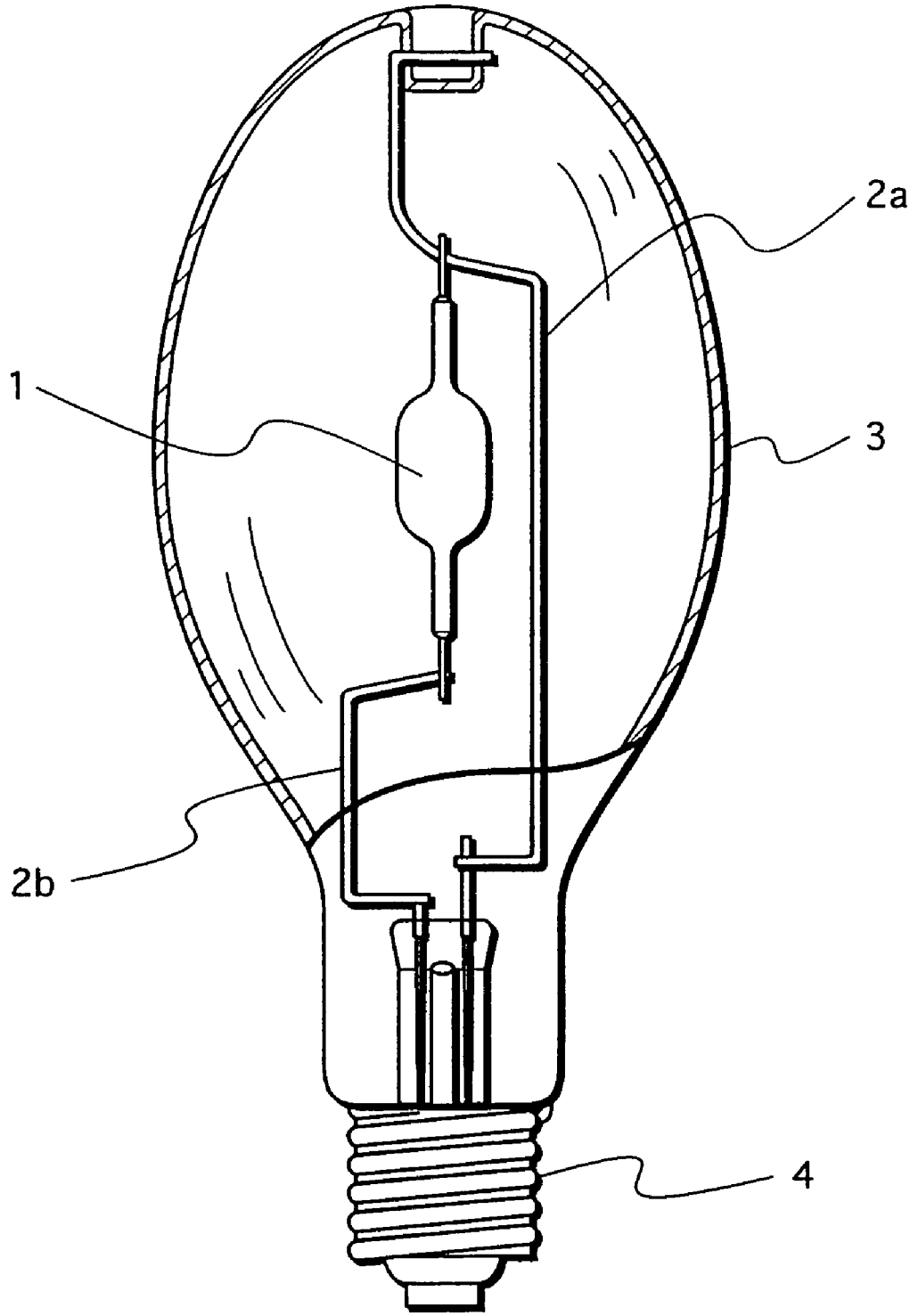
FIG. 1 is a front view of a metal vapor discharge lamp in an embodiment of the present invention, showing the construction thereof.

FIG. 1 is a front view (including a partial sectional view) of a metal vapor discharge lamp in Embodiment 1, showing the construction thereof.

As shown in FIG. 1, the metal vapor discharge lamp includes an outer tube 3 in which nitrogen is sealed at a certain pressure. In the outer tube 3, an arc tube 1 made of translucent ceramic is held at a certain position by power transmission lines 2*a* and 2*b*. A base 4 is attached to a sealed end of the outer tube 3.

Figure 2:
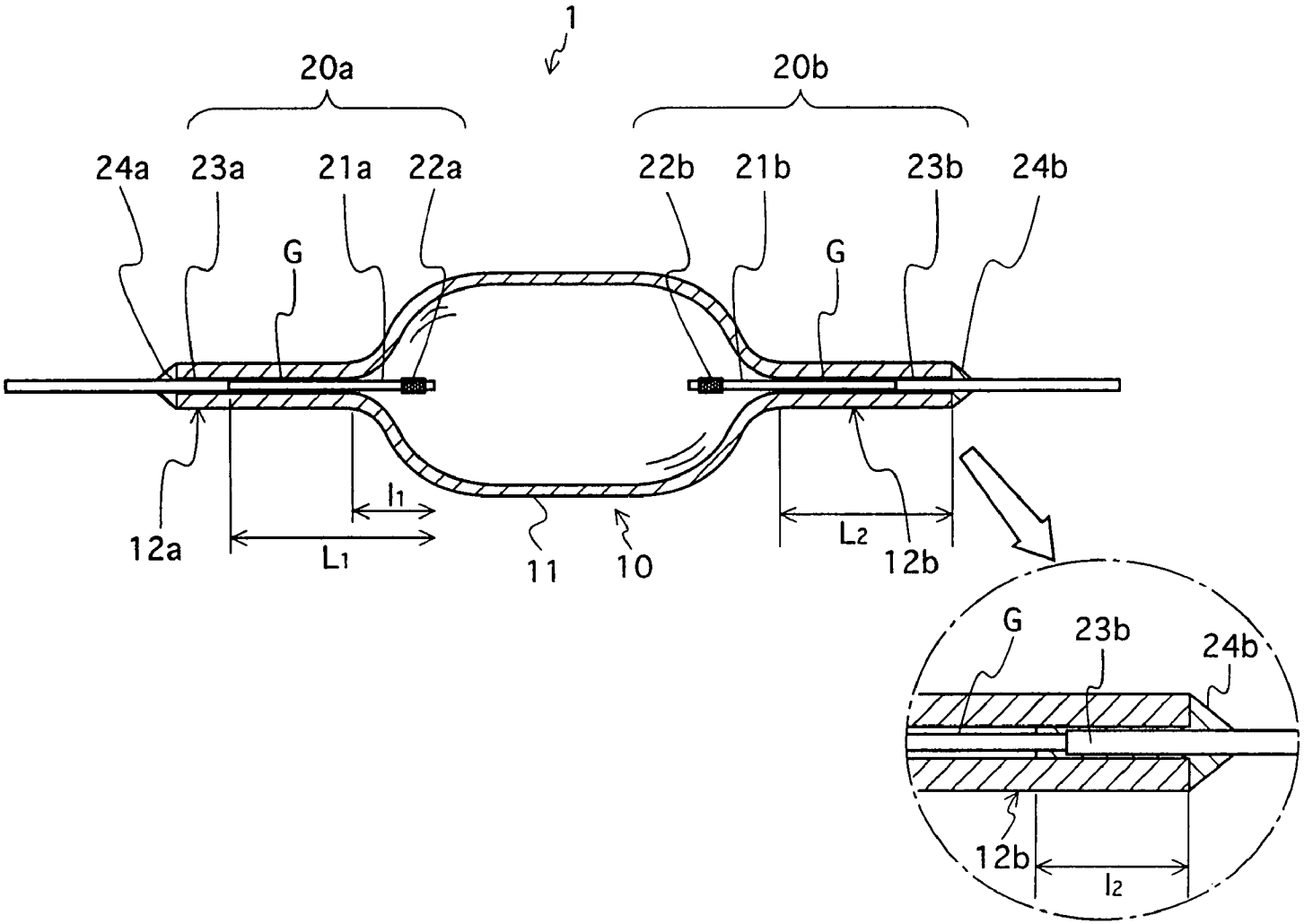
FIG. 2 is a sectional view of the arc tube 1, showing an example of the construction thereof.

FIG. 2 is a sectional view of the arc tube 1.

As shown in FIG. 2, the arc tube 1 includes a container 10 and power transmission members 20*a* and 20*b*. The container 10 is divided into narrow tube portions 12*a* and 12*b* and a main tube portion (light emission portion) 11. The power transmission members 20*a* and 20*b* are inserted into the container 10 through the narrow tube portions 12*a* and 12*b*, respectively. A typical translucent ceramic used as the material of the container 10 is alumina ceramic.

The power transmission members 20*a* and 20*b* include electrode pins 21*a* and 21*b*, respectively. Coils 22*a* and 22*b* made of tungsten are wound around ends of electrode pins 21*a* and 21*b*, respectively. The electrode pins 21*a* and 21*b* are respectively joined with electrode supporting members 23*a* and 23*b* made of conductive cermet, at the other ends thereof. It should be noted here that the conductive cermet is produced by mixing metal powder with ceramic powder and baking the mixture, and its coefficient of thermal expansion is approximately equal to that of ceramic.

The electrode pins 21*a* and 21*b* are respectively joined with the electrode supporting members 23*a* and 23*b* by laser beam welding. By the butt resistance welding, they are apt to be joined weakly since cermet has a large resistivity. In contrast, the laser beam welding joins them strongly enough to almost prevent separation during the lamp life.

The electrode pins 21*a* and 21*b* are joined with the electrode supporting members 23*a* and 23*b* in the narrow tube portions 12*a* and 12*b* of the container 10.

The electrode pins 21*a* and 21*b* thrust out into the main tube portion 11 of the container 10 from the narrow tube portions 12*a* and 12*b* so that both ends thereof, with the coils 22*a* and 22*b* wound around them, face each other in the main tube portion 11, where the space in the main tube portion 11 functions as a discharge space.

The electrode supporting members 23*a* and 23*b* extend out from the narrow tube portions 12*a* and 12*b* to outside, respectively. The spaces between the electrode supporting members 23*a* and 23*b* and the narrow tube portions 12*a* and 12*b* are sealed at the ends near outside respectively by sealing members 24*a* and 24*b* that are formed by pouring a glass frit into the spaces from outside. The glass frit includes a metal oxide, alumina, and silica.

Mercury, rare gas, and light emitting metal are enclosed in the discharge space in the main tube portion 11.

The metal vapor discharge lamp with the above-described construction continues to emit light while an external driving circuit keeps applying to the power transmission members 20*a* and 20*b* a sine wave voltage with 60 Hz of frequency and 283 volts of peak voltage, via the base 4 and the power transmission lines 2*a* and 2*b*.

Construction of Lighting Apparatus

Figure 3:
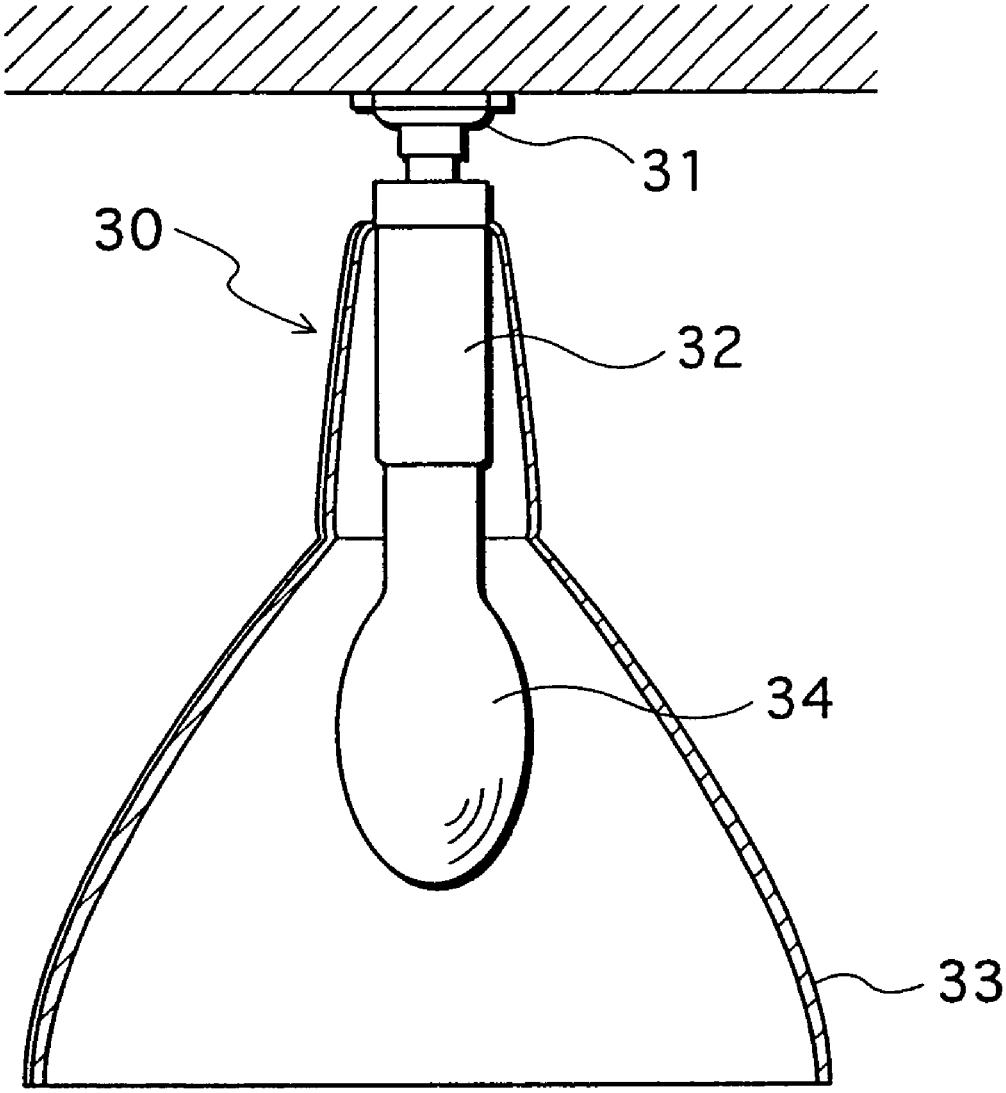
FIG. 3 shows the construction of a lighting apparatus in an embodiment of the present invention.

FIG. 3 is a sectional view of a lighting apparatus to which the metal vapor discharge lamp is attached.

As shown in FIG. 3, the lighting apparatus 30 is composed of a main body and the above-described metal vapor discharge lamp 34 attached to the main body. The main body is composed of a foundation 31, a socket 32, and a reflective hood 33. The foundation 31 is used to fix the lamp to the ceiling or the like. The socket 32 is attached to the foundation 31. The metal vapor discharge lamp 34, while it is positioned base side up, is attached to the socket 32, with the base 34 being fitted into the socket 32. The reflective hood 33 is conical, and its inner surface is reflective. The reflective hood 33 is fixed opening side down, with the metal vapor discharge lamp 34 surrounded by the reflective surface thereof. Note that a lighting circuit apparatus (not illustrated) is provided at a place separated from the lighting apparatus.

The metal vapor discharge lamp 34 emits light when power is supplied from the lighting circuit apparatus via the socket 32, and some part of the emitted visible light travels downward directly through the opening, other part being reflected from the reflective surface of the reflective hood 33 and traveling downward.

Relation between Electrode Length L1 and Lamp Characteristics

In the present embodiment, the length of the electrode pins 21*a* and 21*b* is referred to as an electrode length, and the electrode length is set to a value satisfying the conditions of the following Formula 1.

$$0.041P+0.5 \leqq L1 \leqq 0.041P+8.0, \qquad \text{Formula 1}$$

where "L1" indicates the electrode length (mm), and "P" the lamp power (W).

As will be described in detail in this section, by setting the electrode length L1 to a value in the range specified by the Formula 1, the light emission metal enclosed in the arc tube is prevented from slipping into the spaces between the inner surfaces of the narrow tube portions and the electrode pins 21*a* and 21*b*. This setting of the electrode length also prevents cracks from occurring in the sealing member, and suppresses the reaction between the sealing member and the light emission metal. This prevents the color temperature from changing for a long time, and achieves a long life of the lamp.

This will be described in detail.

Whether it is easy for the light emission metal to slip into the spaces depends on the temperature in the gap G. Here, the gap G is all spaces between the electrode pins 21*a* and 21*b* and the narrow tube portions 12*a* and 12*b*, not filled with the sealing material. Especially, the temperatures in the vicinities of ends of the sealing members 24*a* and 24*b* are important.

More specifically, if the temperature of the electrode pins 21*a* and 21*b* are lower in the narrow tube portions 12*a* and 12*b* than in the discharge space, and if the temperature of the inner surfaces of the narrow tube portions 12*a* and 12*b* surrounding the electrode pins 21*a* and 21*b* is lower than the discharge space, the enclosed light emission metal becomes liquid in the gap G, and the liquid of the light emission metal sinks into the gap G.

In contrast, when the electrode length L1 is set to a value of no larger than (0.041P+8.0) mm, the temperature in the gap G is kept high enough to have the liquid of the light emission metal vaporized.

The mechanism is considered as follows.

The electrode pins 12*a* and 12*b*, having high heat conductivity, are apt to conduct the heat from the positive column. In contrast, the electrode supporting members 23*a* and 23*b*, having low heat conductivity, are difficult to conduct the heat from the electrode pins 21*a* and 21*b*. Accordingly, the temperature in the gap G, especially in the vicinities of ends of the sealing members 24*a* and 24*b*, is affected greatly by the length (thermal capacity) of the electrode pins 21*a* and 21*b*. The longer the electrode pins 21*a* and 21*b* are, the greater the thermal capacity is, and the temperature in the gap G, especially in the vicinities of ends of the sealing members 24*a* and 24*b*, becomes lower (conversely, the shorter the electrode pins 21*a* and 21*b* are, the higher the temperature in the gap G is).

As described above, in the present embodiment, the temperature in the gap G, especially in the vicinities of ends of the sealing members 24*a* and 24*b*, is kept high, and this prevents the light emission metal from sinking into the spaces between the inner surfaces of the narrow tube portions and the electrode pins 21*a* and 21*b*.

Conversely, if the electrode length L1 is too short, the temperature of the ends of the sealing members 24*a* and 24*b* on the gap G side becomes too high, which promotes the reaction between the sealing material and the light emission metal.

In case the electrode pins 21*a* and 21*b* are joined with the electrode supporting members 23*a* and 23*b* by laser beam welding, the surface of the welded portion becomes alumina-rich, and the reaction between the welded portion exposed to the gap G and the light emission metal is promoted. The reaction of the light emission metal increases the tube voltage, which is apt to make the lamp go out in an early stage, reducing the lamp life.

Also, if the temperature at the ends of the sealing members 24*a* and 24*b* becomes too high, cracks are apt to occur in the sealing members 24*a* and 24*b*.

On the other hand, if the electrode length L1 is set to a value that is no smaller than (0.041P+0.5) mm, the temperature at the ends of the sealing members 24*a* and 24*b* does not rise to too high a level. This prevents cracks from occurring in the sealing members 24*a* and 24*b*, and prevents the reaction between the sealing material and the light emission metal.

Projected Electrode Length 11

It is preferable that a length of a portion of the electrode pins 21*a* and 21*b* projecting from the narrow tube portions 12*a* and 12*b* into the discharge space, which is referred to as a projected electrode length in the present document, is set to no smaller than 3.0 mm and no greater than 6.5 mm. The reasons are as follows.

If the projected electrode length is smaller than 3.0 mm, the tube wall becomes too close to the positive column in the vicinities of the boundaries between the main tube portion 11 and the narrow tube portions 12*a* and 12*b*. This promotes the occurrence of cracks due to the thermal shock and promotes the reaction between the tube wall and the enclosed metal (light emission metal). Also, if the projected electrode length is larger than 6.5 mm, the distances between the positive column and the narrow tube portions 12*a* and 12*b* become too large, which makes the temperatures of the narrow tube portions 12*a* and 12*b* and the gap G to be too low. This allows the enclosed metal (light emission metal) to sink into the spaces between the inner surfaces of the narrow tube portions and the electrode pins 21*a* and 21*b*. It should be noted here that the boundaries between the narrow tube portions 12*a* and 12*b* and the discharge space are portions where the inside diameters of the narrow tube portions 12*a* and 12*b* start to increase substantially.

Examples of Coils 25*a* and 25*b*

In the example shown in FIG. 2, the gap G exists between the inner surfaces of the narrow tube portions 12*a* and 12*b* and the outer surfaces of the electrode pins 21*a* and 21*b*, the distance between the surfaces in the gap G is equal to a difference between their diameters.

Figure 4:
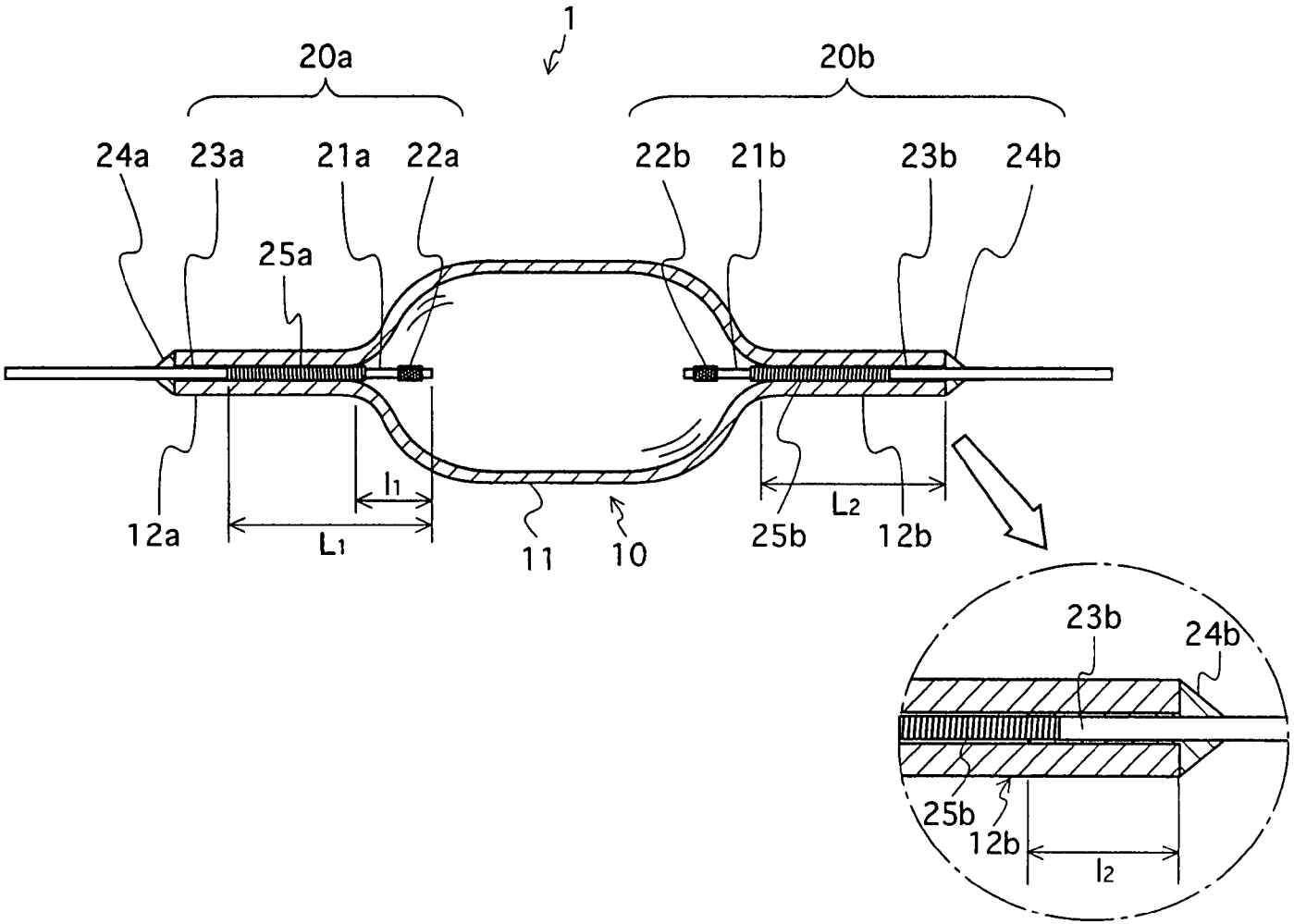
FIG. 4 is a sectional view of the arc tube 1, showing an example of the construction thereof.

FIG. 4 shows an example in which coils 25*a* and 25*b* made of molybdenum are wound around the electrode pins 21*a* and 21*b* at the portions surrounded by the narrow tube portions 12*a* and 12*b*.

With such an arrangement, the gap G is filled with the coils 25*a* and 25*b* to a great extent, reducing the amount of light emission metal that sinks into the gap, and making it difficult for the reaction between the sealing material and the light emission metal. However, since the gap G is not entirely filled with the coils 25*a* and 25*b*, the light emission metal sinks into the gap and the reaction between the sealing material and the light emission metal occurs.

Here, the construction can be combined with the setting of the electrode length L1 (mm) to a value satisfying the condition of the Formula 1 to obtain the same effect as in the example shown in FIG. 2. That is to say, with this combination, the light emission metal is prevented from sinking into the spaces between the inner surfaces of the narrow tube portions and the electrode pins 21*a* and 21*b*, and the reaction between the sealing material and the light emission metal is also prevented.

Shape of Electrodes and Electrode Length L1

Figure 5A:
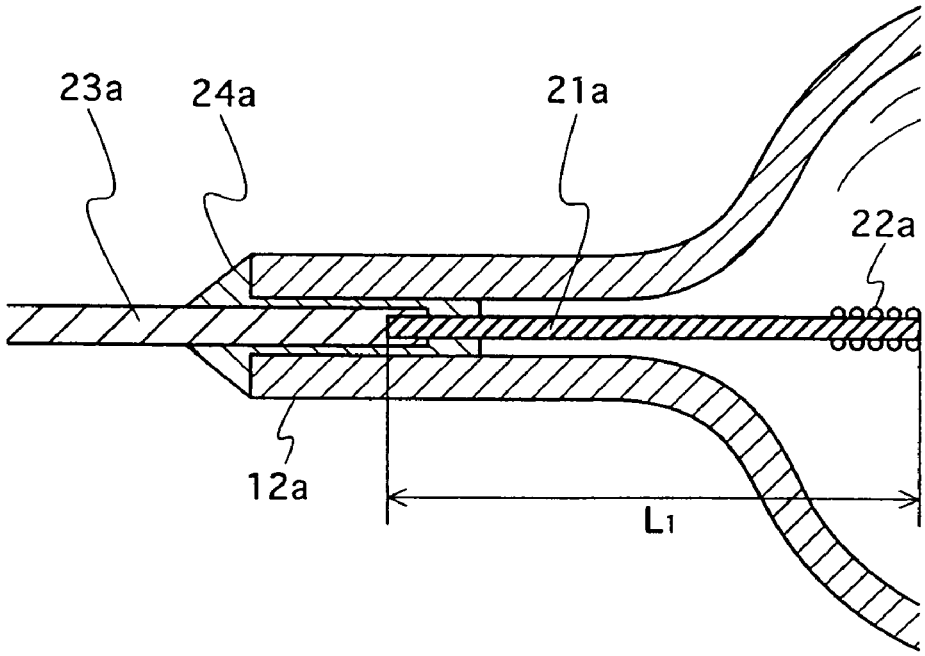
FIGS. 5A and 5B are sectional views of the arc tube, provided for the explanation of the electrode length L11.
Figure 5B:
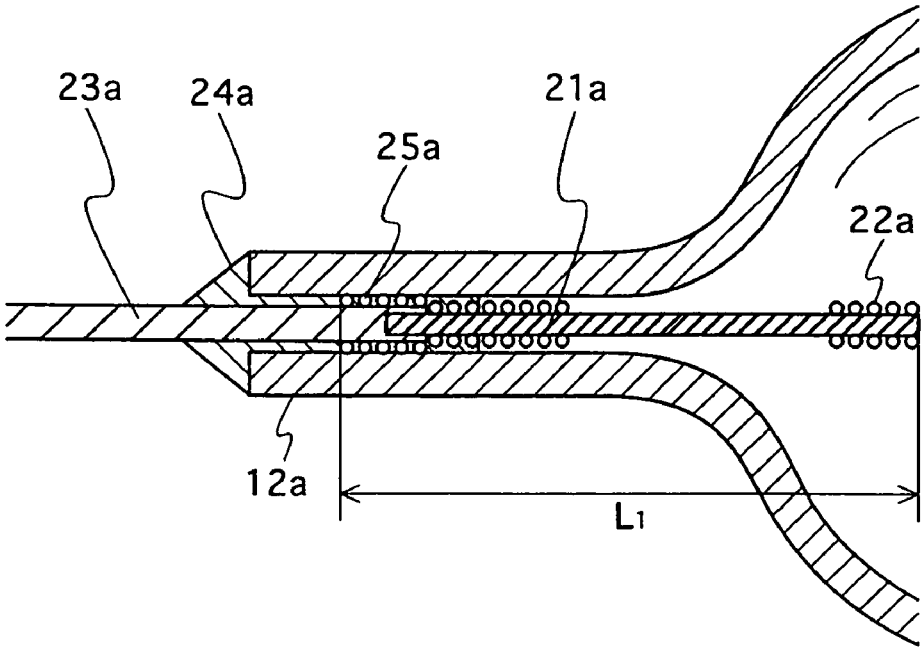

FIGS. 5A and 5B are sectional views of the arc tube, provided for the explanation of the electrode length L1. Generally, the length of electrode (electrode length L1) is defined as the length of the electrode pin 21*a* (21*b*), or a distance between a tip of the coil 22*a* (22*b*) and the end of the electrode supporting member 23*a* (23*b*) on the discharge space side. This applies to the example shown in FIG. 5A, in which the end portion of the electrode pin 21*a* (21*b*) is embedded into the electrode supporting member 23*a* (23*b*). In this case, the electrode length L1 is equal to the length of the electrode pin 21*a* (21*b*).

On the other hand, in the example shown in FIG. 5B, in which the coil 25*a* (25*b*) is wound around the electrode pin 21*a* (21*b*) and the electrode supporting member 23*a* (23*b*) in succession in the narrow tube portion 12*a* (12*b*), the electrode length L1 is defined as a distance between (i) a tip of the electrode pin 21*a* (21*b*) or the coil 22*a* (22*b*) in the discharge space and (ii) the end of the coil 25*a* (25*b*) (on the outside side).

Heat Conductivity of Electrodes and Electrode Supporting Members

As described above, tungsten, which is a refractory metal, is used as the material of the electrode pins 21*a* and 21*b* and the coils 22*a* and 22*b*. Tungsten has a heat conductivity of no lower than 130 (W/m*K). Also, as shown in FIG. 4, coils 25*a* and 25*b* made of molybdenum may be wound around the electrode pins 21*a* and 21*b*. Molybdenum also has a heat conductivity of no lower than 130 (W/m*K).

Accordingly, both of (i) electrodes composed of electrode pins 21*a* and 21*b* and coils 22*a* and 22*b*, and (ii) electrodes composed of electrode pins 21*a* and 21*b*, coils 22*a* and 22*b*, and coils 25*a* and 25*b* have a heat conductivity of no lower than 130 (W/m*K).

On the other hand, a conductive cermet is used as the material of electrode supporting members 23*a* and 23*b*. It is preferred that the heat conductivity of the conductive cermet used as the material of electrode supporting members 23*a* and 23*b* is lower than that of the electrodes and that it is no higher than 100 (W/m*K).

This is because, as apparent from the results of Experiment 2 which will be provided later, when the heat conductivity of the electrode supporting members 23*a* and 23*b* is as high as the electrodes, heat is apt to escape from the electrode pins to the electrode supporting members. This decreases the temperature in the gap G, causing the light emission metal to slip into the spaces between the inner surfaces of the narrow tube portions and the electrode pins.

Relation between Narrow Tube Portion Length L2 and Lamp Characteristics

In the present embodiment, the length of the narrow tube portions is referred to as a narrow tube portion length, and the narrow tube portion length is set to a value satisfying the conditions of the following Formula 2.

$$0.032P+3.5 \leqq L2 \leqq 0.032P+8.0, \qquad \text{Formula 2}$$

where "L2" indicates the narrow tube portion length (mm), and "P" the lamp power (W).

Here, the narrow tube portion length L2 is a length of a portion of the narrow tube portion 12*a* (12*b*) extending from an end to a position where the tube diameter starts to increase. Generally, the diameter of the arc tube is substantially constant through a portion that corresponds to the narrow tube portion length L2.

As apparent from the results of Experiment 3 that will be shown later, with this arrangement of setting the narrow tube portion length L2 to a value satisfying the conditions of the following Formula 2, the enclosed light emission metal is prevented from sinking into the spaces between the inner surfaces of the narrow tube portions and the electrode pins 21*a* and 21*b*. This setting of the narrow tube portion length also prevents cracks from occurring in the sealing member, and suppresses the reaction between the sealing member and the light emission metal. This prevents the color temperature from changing for a long time, and achieves a long life of the lamp.

To increase the reliability of reducing the amount of light emission metal sinking into the spaces, it is preferable to set the electrode length L1 to a value satisfying the conditions of Formula 1, and to set the narrow tube portion length L2 to a value satisfying the conditions of Formula 2.

This will be described in detail.

Whether it is easy for the light emission metal to slip into the spaces depends on the temperature in the gap G.

More specifically, if the temperature of the electrode pins 21*a* and 21*b* are lower in the narrow tube portions 12*a* and 12*b* than in the discharge space, and if the temperature of the inner surfaces of the narrow tube portions 12*a* and 12*b* surrounding the electrode pins 21*a* and 21*b* is lower than the discharge space, the enclosed light emission metal becomes liquid in the gap G, not vaporized, and the liquid of the light emission metal sinks into the gap G.

In contrast, when the narrow tube portion length L2 is set to a value of no larger than (0.032P+8.0) mm, the temperature in the gap G is kept high enough to have the liquid of the light emission metal vaporized.

The mechanism is considered to be as follows.

The temperature in the gap G, especially in the vicinities of ends of the sealing members 24*a* and 24*b*, is affected greatly by the narrow tube portion length L2. The longer the narrow tube portion length L2 is, the longer the distance from the positive column is, the greater the thermal capacity is, the lower the temperature in the gap G, especially in the vicinities of ends of the sealing members 24*a* and 24*b*, is (conversely, the shorter the narrow tube portion length L2 is, the higher the temperature in the gap G is).

Conversely, if the narrow tube portion length L2 is too short, the temperature of the ends of the sealing members 24*a* and 24*b* on the gap G side becomes too high, which promotes the reaction between the sealing material and the light emission metal.

In case the electrode pins 21*a* and 21*b* are joined with the electrode supporting members 23*a* and 23*b* by laser beam welding, the surface of the welded portion becomes alumina-rich, and the reaction between the welded portion exposed to the gap G and the light emission metal is promoted. The reaction of the light emission metal increases the tube voltage, which is apt to cause the lamp to go out in an early stage, reducing the lamp life.

Also, if the temperature at the ends of the sealing members 24*a* and 24*b* becomes too high, cracks are apt to occur in the sealing members 24*a* and 24*b*.

On the other hand, if the narrow tube portion length L2 is set to a value of no smaller than (0.032P+3.5) mm, the temperature at the ends of the sealing members 24*a* and 24*b* does not become too high. This prevents cracks from occurring in the sealing members 24*a* and 24*b*, and prevents the reaction between the sealing material and the light emission metal.

Relation between Narrow Tube Portion Length L2 and Lamp Turn-On Failure

When a metal vapor discharge lamp uses a light emission metal that contains cerium, the lamp may go out immediately after the lamp is turned on. The phenomenon occurs especially in the initial aging lighting process that is performed immediately after the lamp is manufactured. However, occurrence of this problem can also be reduced by setting the narrow tube portion length L2 to a value satisfying the conditions of Formula 2.

The effect of reducing the turn-on failure can be enhanced by setting the narrow tube portion length L2 to a value satisfying the conditions of the following Formula 3.

$$0.032P+3.5 \leqq L2 \leqq 0.032P+6.0, \qquad \text{Formula 3}$$

where "L2" indicates the narrow tube portion length (mm), and "P" the lamp power (W).

Now, the mechanism of turn-on failure occurrence and its suppression achieved by setting the narrow tube portion length L2 to a small value will be described.

Figure 6:
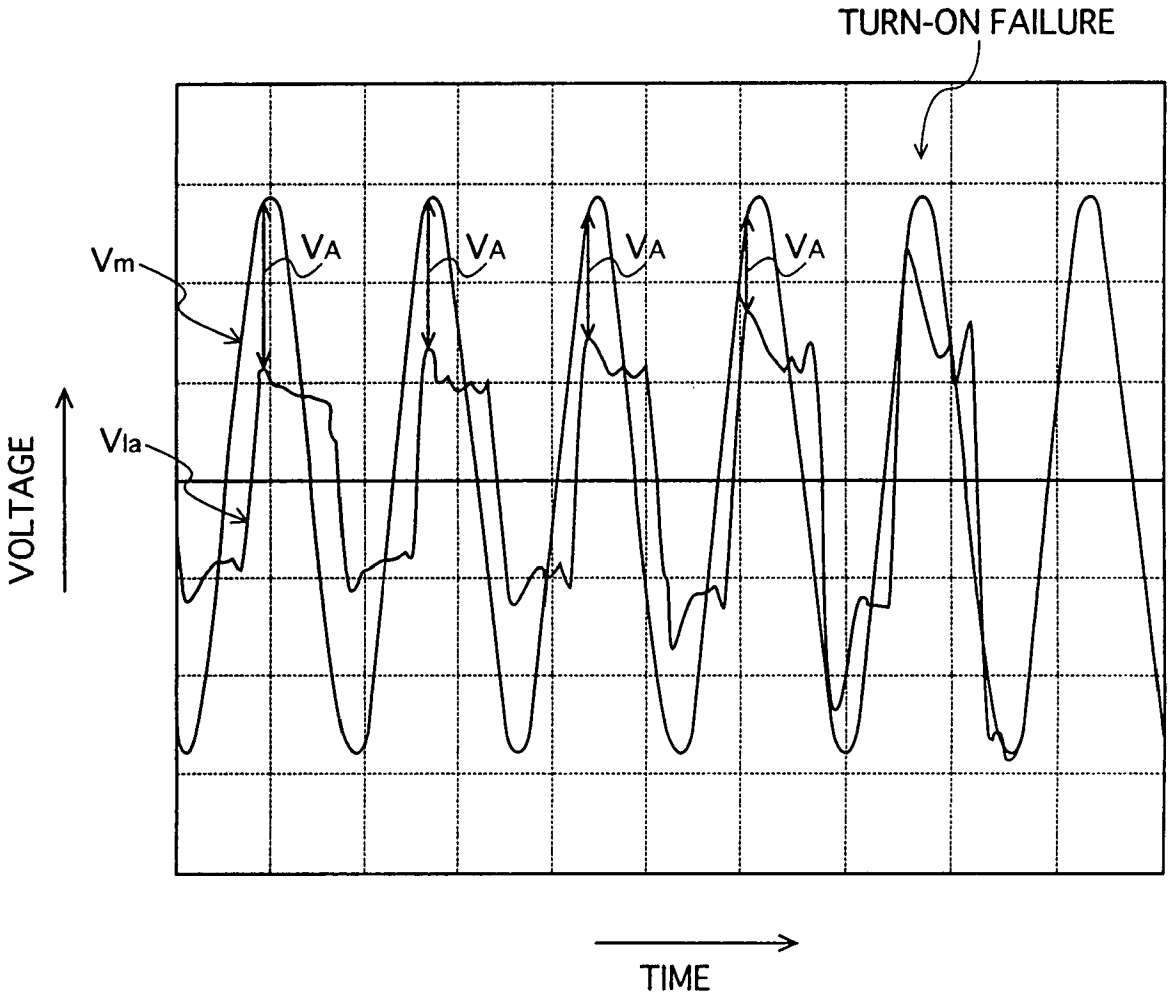
FIG. 6 is an illustration related to the mechanism of turn-on failure occurrence.

FIG. 6 is an illustration related to the mechanism of turn-on failure occurrence.

In FIG. 6, "Vm" represents a supply voltage input to a driving circuit, and "Vla" a lamp voltage applied to a lamp.

In FIG. 6, the voltage at the peak of the lamp voltage waveform corresponds to a restrike voltage.

After the lamp is turned on, the lamp voltage Vla increases gradually. Here, if the light emission metal contains cerium (Ce), the restrike voltage is apt to increase drastically several seconds after the lamp is turned on. In regard with the graph shown in FIG. 6, it is found that the restrike voltage increases drastically at the fifth wave. This is because cerium is vaporized abruptly when the temperature of the walls of the arc tube increases to a certain level after the lamp is turned on, causing an irregular arc discharge.

Here, when the speed at which the temperature of the arc tube wall increases is low, it takes a long time before the temperature of the arc tube wall rises to the level that causes cerium to be vaporized. In this case, when the restrike voltage increases drastically due to the sudden vaporization of cerium, the lamp voltage Vla has increased to a considerable level, which causes the restrike voltage to increase even more. As a result, it may happen that the difference VA between the supply voltage Vm and the restrike voltage at this point is "0".

In the graph shown in FIG. 6, it is observed that the restrike voltage increases drastically at the fifth wave, so that the difference VA between the supply voltage Vm and the restrike voltage is 0.

The lamp goes out the moment the difference VA between the supply voltage Vm and the restrike voltage becomes 0, as is the case described above.

In contrast, when the narrow tube portion length L2 is set to a small value, the speed at which the temperature of the arc tube wall increases becomes fast, and cerium is vaporized in a short time period. In this case, when cerium is vaporized, the lamp voltage Vla has not risen to such a considerable level, and even if the restrike voltage increases here, there is little possibility that the difference VA between the supply voltage Vm and the restrike voltage becomes "0".

It has been confirmed through experiments that in a metal vapor discharge lamp in which 13.5 mg of light emission metal has been enclosed in the discharge space, and the light emission metal is composed of: CeI3 (5.4 mg of cerium); NaI (7.1 mg of sodium); TlI (0.6 mg of thallium); and InI (0.4 mg of indium), the lamp turn-on failure can be suppressed by setting the narrow tube portion length L2 to no larger than (0.032P+8.0) mm.

Sealing Material Insertion Length 12 and Thickness of Arc Tube Container

In the present embodiment, the length of the sealing material inserted into the narrow tube portion is referred to as a sealing material insertion length 12, and it is preferred that the sealing material insertion length is set to a value satisfying the conditions of the following Formula 4.

$$3.7 \leqq 12 \leqq 5.5, \qquad \text{Formula 4}$$

where "12" indicates the sealing material insertion length (mm).

As apparent from the results of Experiment 4 that will be detailed later, the setting of the length enhances the reliability of the sealing member during life, and stabilize the characteristics.

In the case of ordinary ceramic light emission container, thickness t2 of the narrow tube portions is no smaller than 1.15 times thickness t1 of the main tube portion.

As in this case, when the narrow tube portion is thicker than the main tube portion (that is, t2>t1), the temperature in the gap G, especially in the vicinities of ends of the sealing members 24*a* and 24*b*, is apt to be low. In such a case, setting the narrow tube portion length L2 to a value satisfying the conditions of the Formula 2 or 3 is effective in preventing the light emission metal from sinking into the spaces between the inner surfaces of the narrow tube portions and the electrode pins 21*a* and 21*b*.

Variations and Others

The problem of the sinking light emission metal mainly occurs to a lower narrow tube portion when the electrodes are held vertically. Accordingly, when it is known in advance which of the narrow tube portions 12*a* and 12*b* is positioned lower, the above-explained settings of the lengths including the narrow tube portion length L2 may be applied only to the lower narrow tube portion. This is expected to provide the same effects.

Otherwise, it is preferable that the above-explained settings of the lengths are applied to both of the narrow tube portions 12*a* and 12*b* since any of these may be positioned lower.

EXAMPLES

Examples of the metal vapor discharge lamp in the present embodiment were prepared, with the lamp power P=300 W. The types and sizes of the components were as follows.

The narrow tube portion length L2 was set to 15.8 mm.

The electrode pins 21*a* and 21*b* had an outside diameter of 0.71 mm and a length of 17.8 mm.

The conductive cermet for the electrode supporting members 23*a* and 23*b* was formed by baking a mixture of molybdenum and alumina. The coefficient of thermal expansion of the conductive cermet was $7.0\times10^{-6}$, and the heat conductivity was 70 (W/m*K). The electrode supporting members 23*a* and 23*b* had an outside diameter of 1.3 mm and a length of 30 mm.

The amount of light emission metal enclosed in the discharge space was 13.5 mg. The light emission metal was composed of 2.6 mg of $DyI_3$, 2.6 mg of $HoI_3$, 2.6 mg of $TmI_3$, 3.3 mg of NaI, and 2.4 mg of TlI. Also, 20 kPa of argon was enclosed in the discharge space as a rare gas.

The narrow tube portions 12*a* and 12*b* had an inside diameter hof 1.3 mm. The thickness t1 of the main tube portion 11 was set to 1.1 mm, and the thickness t2 of the narrow tube portions 12*a* and 12*b* was set to 1.35 mm.

For each of the examples of metal vapor discharge lamps, the following experiments were conducted. In these experiments, electrode pins 21*a* and 21*b* made of molybdenum, with coils 25*a* and 25*b* wound around thereof, were used.

Experiment 1

A 3,000-hour life test was conducted on the examples of metal vapor discharge lamps in which the electrode length L1 was set to 11.8 mm, 12.8 mm, 16.3 mm, 19.8 mm, and 20.8 mm, respectively, and the increase in the tube voltage (V) and change in the color temperature (K) were measured.

The length of the gap G (a distance between a discharge space side end of the narrow tube portion 12*a* (12*b*) and an end surface of the sealing member 24*a* (24*b*)) was fixed to 4.5 mm.

Table 1 shows the results of the experiment.

In the "Estimation" column in Table 1, the sign "○" indicates "good", and the sign "x" indicates "no good" (this also applies to Tables 2–6).

TABLE 1

| Electrode length L1 (mm) | Tube voltage increase @ 3,000 hours | Color temperature change @ 3,000 hours | Estimation |
|---|---|---|---|
| 11.8 | 27 V | 130K | X |
| 12.8 | 15 V | 145K | ○ |
| 16.3 | 7 V | 205K | ○ |

TABLE 1-continued

| Electrode length L1 (mm) | Tube voltage increase @ 3,000 hours | Color temperature change @ 3,000 hours | Estimation |
|---|---|---|---|
| 19.8 | 10 V | 280K | ○ |
| 20.8 | 6 V | 550K | X |

The experiment results of Table 1 indicate that the examples of metal vapor discharge lamps having 12.8 mm or larger of electrode length L1 have very small increases in the tube voltage per 3,000 hours.

It is considered that this is because the temperature at the ends of the sealing members 24*a* and 24*b* increases enough to promote the reaction with the light emission metal when the electrode length L1 is 12.8 mm or smaller, and in contrast, the temperature is suppressed from rising when the electrode length L1 is smaller than 12.8 mm.

The experiment results of Table 1 also indicate that the examples of metal vapor discharge lamps having no smaller than 19.8 mm of electrode length L1 have very small changes in the color temperature per 3,000 hours.

It is considered that this is because the temperature at the inner wall surfaces of the narrow tube portions is kept high enough to suppress the light emission metal from sinking into the gap.

As understood from the results of the experiment, in the metal vapor discharge lamps with the lamp power P=300 W, the tube voltage increase and color temperature change can be suppressed when the electrode length L1 is set to a value in a range of 12.8 mm to 19.8 mm (that is, the range specified by Formula 1).

A 3,000-hour life test was also conducted on the examples of metal vapor discharge lamps with the lamp power P=70 W in which the electrode pins 21*a* and 21*b* have an outside diameter of 0.35 mm, and the electrode length L1 was set to 3.0 mm, 3.5 mm, 7.0 mm, 10.8 mm, and 11.3 mm, respectively, and the increased tube voltage increase (V) and the color temperature change (K) were measured.

Table 2 shows the results of the experiment, and as understood from the results, the tube voltage increase and color temperature change can be suppressed when the electrode length L1 is set to a value in a range of 3.5 mm to 10.8 mm (that is, the range specified by Formula 1).

TABLE 2

| Electrode length L1 (mm) | Tube voltage increase @ 3,000 hours | Color temperature change @ 3,000 hours | Estimation |
|---|---|---|---|
| 3.0 | 24 V | 155K | X |
| 3.5 | 18 V | 170K | ○ |
| 7.0 | 7 V | 200K | ○ |
| 10.8 | 5 V | 240K | ○ |
| 11.3 | 5 V | 510K | X |

It should be noted here that similar experiments were conducted on metal vapor discharge lamps with the lamp power P=70 W to 400 W as well, and it was confirmed that the tube voltage increase and color temperature change during life can be suppressed when the electrode length L1 is set to a value satisfying the conditions specified by Formula 1.

Similar experiments were also conducted for various ratios of the compositions of the light emission metal, and it was confirmed that the tube voltage increase and color temperature change during life can be suppressed when the electrode length L1 is set to a value satisfying the conditions specified by Formula 1, regardless of the ratio of the compositions of the light emission metal.

Experiment 2

A 3,000-hour life test was conducted on the examples of metal vapor discharge lamps in which the electrode length L1 was fixed to 17.8 mm and cermets with 70, 100, and 110 W/m*K of heat conductivity and molybdenum with 138 W/m*K of heat conductivity were used as the materials of the electrode supporting members, respectively, and change in the color temperature (K) was measured.

Table 3 shows the results of the experiment.

TABLE 3

| Electrode supporting member material | Heat conductivity (K/m*K) | Color temperature change @ 3,000 hours | Estimation |
|---|---|---|---|
| Cermet | 70 | 200K | ○ |
| Cermet | 100 | 240K | ○ |
| Cermet | 110 | 380K | X |
| Molybdenum | 138 | 525K | X |

As understood from the results, when a material with no smaller than 100W/m*K of heat conductivity is used as the material of the electrode supporting members 23*a* and 23*b*, the color temperature changes greatly during life. It is considered that this is because when the electrode supporting members have high heat conductivity, the heat is apt to escape from the electrode pins to the electrode supporting members, which decreases the temperature in the gap G, especially in the vicinities of ends of the sealing members 24*a* and 24*b*, and causes the light emission metal to sink into the gap.

Experiment 3

A 3,000-hour life test was conducted on the examples of metal vapor discharge lamps in which the narrow tube portion length L2 was set to 10.0 mm, 11.6 mm, 13.1 mm, 15.0 mm, 17.6 mm, and 19.1 mm, respectively, and probability of crack occurrence and change in the color temperature were measured.

The electrode length L1 was fixed to 17.6 mm, and the sealing material insertion length L2 was fixed to 4.5 mm.

Table 4 shows the results of the experiment.

In the "Estimation" column in Table 4, the sign "◎" indicates "excellent" (this also applies to Table 5).

TABLE 4

| Narrow tube portion length L2 (mm) | Probability of crack occurrence @ 3,000 hours | Color temperature change @ 3,000 hours | Estimation |
|---|---|---|---|
| 10.0 | 4/8 | 155K | X |
| 11.6 | 1/10 | 185K | X |
| 13.1 | 0/10 | 220K | ◎ |
| 15.6 | 0/10 | 230K | ◎ |
| 17.6 | 0/8 | 300K | ○ |
| 19.1 | 0/7 | 430K | X |

As understood from the results, cracks occurred to metal vapor discharge lamps in which the narrow tube portion length L2 was set to no larger than 11.6 mm, but the probability of crack occurrence was very low in the examples in which the narrow tube portion length L2 was set to no smaller than 13.1 mm. It is considered that this is because when the narrow tube portion length L2 is no smaller than 13.1 mm, the temperature of the electrode supporting members and sealing members in the narrow tube portions does not rise to too high a level while the lamp is lighted, which prevents these members from reacting with the light emission metal and from thermal expansion.

As described above, it is understood that in the metal vapor discharge lamps with the lamp power P=300 W, the crack occurrence and color temperature change can be suppressed when the narrow tube portion length L2 is set to a value in a range of 13.1 mm to 17.6 mm (that is, the range specified by Formula 0.2).

A 3, 000-hour life test was also conducted on the examples of metal vapor discharge lamps with the lamp power P=70 W in which the narrow tube portion length L2 was set to 4.0 mm, 5.0 mm, 5.8 mm, 8.0 mm, 10.0 mm, and 11.0 mm, respectively, and the crack occurrence probability and the color temperature change (K) were measured.

Table 5 shows the results of the experiment, and as understood from the results, in the metal vapor discharge lamps with the lamp power P=70 W, the crack occurrence probability and the color temperature change can be suppressed when the narrow tube portion length L2 is set to a value in a range of 5.8 mm to 10.0 mm (that is, the range specified by Formula 2).

TABLE 5

| Narrow tube portion length L2 (mm) | Probability of crack occurrence @ 3,000 hours | Color temperature change @ 3,000 hours | Estimation |
|---|---|---|---|
| 4.0 | 3/8 | 165K | X |
| 5.0 | 2/8 | 180K | X |
| 5.8 | 0/10 | 190K | ◎ |
| 8.0 | 0/10 | 210K | ◎ |
| 10.0 | 0/10 | 295K | ○ |
| 11.0 | 0/5 | 500K | X |

A 3,000-hour life test was conducted on the examples of metal vapor discharge lamps in which the electrode length L1 and narrow tube portion length L2 were fixed to 17.6 mm and 15.8 mm, respectively, and the sealing material insertion length 12 was set to 3.2 mm, 3.7 mm, 5.5 mm, and 6.0 mm, respectively, and probability of crack occurrence in the sealing members and change in the color temperature were measured.

Table 6 shows the results of the experiment.

TABLE 6

| Sealing material insertion length 12 (mm) | Probability of crack occurrence @ 3,000 hours | Color temperature change @ 3,000 hours | Estimation |
|---|---|---|---|
| 3.2 | 0/6 | 455K | X |
| 3.7 | 0/8 | 280K | ○ |
| 5.5 | 0/10 | 220K | ○ |
| 6.0 | 2/7 | 200K | X |

As understood from the results, the probability of crack occurrence was very low when the sealing material insertion length l2 was no larger than 5.5 mm. It is considered that this is because when the sealing material insertion length l2 is no larger than 5.5 mm, the temperature of the electrode supporting members and sealing members in the narrow tube portions does not rise to too high a level while the lamp is lighted, which prevents these members from reacting with the light emission metal and from thermal expansion.

On the other hand, it is understood from the results shown in Table 6 that the color temperature changed less during life when the sealing material insertion length l2 was no smaller than 3.7 mm. It is considered that this is-because when the sealing material insertion length l2 was no smaller than 3.7 mm, the temperature of ends of the sealing members was kept high enough to prevent the light emission metal from sinking into the gap G.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion, with an end of each narrow tube portion located on the outside side, and another end of each narrow tube portion located on the main tube portion side such that a gap is formed between each narrow tube portion and each electrode, and a length of each electrode is in a range of (0.041P+0.5) mm to (0.041P+8.0) mm inclusive, wherein "P" represents a lamp power in W, and the lamp power is 70 W to 400 W inclusive.

2. The metal vapor discharge lamp of claim 1, wherein a length of a portion of each electrode projecting from each narrow tube portion into the discharge space is in a range of 3.0 mm to 6.5 mm inclusive.

3. The metal vapor discharge lamp of claim 1, wherein each electrode has heat conductivity of no smaller than 130 W/m*K, and each electrode supporting member has heat conductivity of no larger than 100 W/m*K.

4. The metal vapor discharge lamp of claim 1, wherein each electrode contains tungsten and/or molybdenum, and each electrode supporting member contains cermet.

5. The metal vapor discharge lamp of claim 1, wherein a length of each narrow tube portion is in a range of (0.032P+3.5) mm to (0.032P+8.0) mm inclusive, wherein "P" represents a lamp power in W.

6. The metal vapor discharge lamp of claim 1, wherein the sealing material is inserted into each narrow tube portion from an outer end not facing the discharge space, and a length of the sealing material in each narrow tube portion is in a range of 3.7 mm to 5.5 mm inclusive.

7. The metal vapor discharge lamp of claim 1, wherein the main tube portion and the narrow tube portions are formed in one piece.

8. A metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion, and a length of each narrow tube portion is in a range of (0.032P+3.5) mm to (0.032P+8.0) mm inclusive, wherein "P" represents a lamp power in W, and the lamp power is in a range of 70 W to 360 W inclusive.

9. The metal vapor discharge lamp of claim 8, wherein the sealing material is inserted into each narrow tube portion from an outer end not facing the discharge space, and a length of the sealing material in each narrow tube portion is in a range of 3.7 mm to 5.5 mm inclusive.

10. The metal vapor discharge lamp of claim 8, wherein a thickness of each narrow tube portion is no smaller than 1.15 times a thickness of the main tube portion.

11. The metal vapor discharge lamp of claim 8, wherein each electrode supporting member is made of cermet.

12. The metal vapor discharge lamp of claim 8, wherein the main tube portion and the narrow tube portions are formed in one piece.

13. A metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion, and a length of each narrow tube portion is in a range of (0.032P+3.5) mm to (0.032P+6.0) mm inclusive, wherein "P" represents a lamp power in W, and the lamp power is in a range of 70 W to 360 W inclusive.

14. The metal vapor discharge lamp of claim 13, wherein the light emission metal enclosed in the main tube portion contains cerium.

15. A lighting apparatus that includes a main body, a metal vapor discharge lamp disposed in the main body, and a lighting circuit apparatus connected to the metal vapor discharge lamp, the metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion with an end of each narrow tube portion located on the outside side, and another end of each narrow tube portion located on the main tube portion side, such that a gap is formed between each narrow tube portion and each electrode, and a length of each electrode is in a range of (0.041P+0.5) mm to (0.041P+8.0) mm inclusive, wherein "P" represents a lamp power in W, and the lamp power is in a range of 70 W to 360 W inclusive.

16. A lighting apparatus that includes a main body, a metal vapor discharge lamp disposed in the main body, and a lighting circuit apparatus connected to the metal vapor discharge lamp, the metal vapor discharge lamp having an arc tube, wherein the arc tube includes a container made of translucent ceramic, the container being divided into a main tube portion and two narrow tube portions respectively extending out from both ends of the main tube portion, a discharge space is formed in the main tube portion with a light emission metal being enclosed in the discharge space, an electrode is deposited in each narrow tube portion, a coil being wound around the electrode at an end thereof facing the discharge space, an electrode supporting member is inserted in each narrow tube portion and connected to the other end of the electrode, the arc tube is sealed by a sealing material that is inserted into each space between each electrode supporting member and each narrow tube portion, and a length of each narrow tube portion is in a range of (0.032P+3.5) mm to (0.032P+8.0) mm inclusive, wherein "P" represents a lamp power in W, and the lamp power is in a range of 70 W to 360 W inclusive.

17. A metal vapor discharge lamp having an arc tube of a translucent ceramic including a main tube portion and two integral narrow tube portions with longitudinal openings, one narrow tube portion extends respectively from opposite ends of the main tube portion, a hollow discharge space is provided in the main tube portion having a light emission metal, comprising;

an electrode supporting member having a coefficient of thermal expansion approximately that of the ceramic is positioned in and extends from each longitudinal opening to an exterior of each narrow tube portion;

an electrode is laser welded to each electrode supporting member and is cantilevered from the electrode supporting member to extend from the longitudinal opening into the discharge space; and a sealing material is positioned between each electrode supporting member the corresponding narrow tube portion within the longitudinal opening to seal the discharge space while leaving a predetermined length of gap around the electrode and the narrow tube portion, the sealing material extends within the longitudinal opening from the exterior of each narrow tube portion towards the discharges space a distance between 3.7 mm and 5.5 mm, wherein each electrode extends into the discharge space a distance between 3.00 mm and 6.5 mm;

heat conductivity of each electrode is no longer than 130 (W/m*k);

heat conductivity of each electrode supporting member is no higher than 100 (W/m*k), wherein W is watts, m is meters, and K is Kelvin, a wall thickness of the narrow tube portion is thicker than a wall thickness of the main tube portion, and a length of each electrode is in a range of (0.041P+0.5) mm to (0.041P+8.0) mm inclusive, wherein "P" represents a lamp power in W, and the lam power is 70 W to 400 W.

18. The metal vapor discharge lamp of claim 17, wherein a thickness of each narrow tube portion is no smaller than 1.15 times a thickness of the main tube portion.

19. The metal vapor discharge lamp of claim 17, wherein a length of each narrow tube portion is in a range of (0.032P+3.5) mm to (0.03P+8.0) mm, wherein "P" represents a lamp power in W.

20. The metal vapor discharge lamp of claim 19, wherein the light emission metal enclosed in the main tube portion contains cerium.

21. The metal vapor discharge lamp of claim 20, wherein the electrode is tungsten and helical coils of molybdenum are wrapped around the electrode.

22. The metal vapor discharge lamp of claim 20, wherein a length of each narrow tube portion is in a range of (0.032P+3.5) mm to (0.032P+6.0) mm.

* * * * *